US005920030A

United States Patent [19]

Day

[11] Patent Number: 5,920,030

[45] Date of Patent: Jul. 6, 1999

[54] METHODS OF BLASTING USING NITROGEN-FREE EXPLOSIVES

[75] Inventor: John T. Day, Sandy, Utah

[73] Assignee: Mining Services International, Sandy, Utah

[21] Appl. No.: 08/850,240

[22] Filed: May 2, 1997

Related U.S. Application Data

[60] Provisional application No. 60/017,034, May 2, 1996.

[51] Int. Cl.[6] ..... F42B 3/00; C06B 21/00

[52] U.S. Cl. ..... 102/313; 149/77; 149/85; 149/109.6; 264/3.3

[58] Field of Search ..... 102/313; 149/77, 149/85, 109.6; 264/3.3

[56] References Cited

U.S. PATENT DOCUMENTS

| | | | |
|---|---|---|---|
| 3,730,093 | 5/1973 | Cummings | 102/6 |
| 3,765,967 | 10/1973 | Funk et al. | 149/21 |
| 3,862,866 | 1/1975 | Timmerman et al. | 149/77 X |
| 3,971,729 | 7/1976 | Timmerman | 149/77 X |
| 4,040,880 | 8/1977 | Rothenstein et al. | 149/77 X |
| 4,111,727 | 9/1978 | Clay | 149/2 |
| 4,152,891 | 5/1979 | Garner | 149/77 X |
| 4,161,142 | 7/1979 | Edwards et al. | 102/23 |
| 4,181,546 | 1/1980 | Clay | 149/21 |
| 4,278,480 | 7/1981 | Johannes | 149/2 |
| 4,294,633 | 10/1981 | Clay | 149/2 |
| 4,416,711 | 11/1983 | Jessop et al. | 149/85 X |
| 4,448,619 | 5/1984 | Mitchell | 149/21 |
| 4,500,370 | 2/1985 | Hajto | 149/109.6 |
| 4,594,118 | 6/1986 | Curtin et al. | 149/2 |
| 4,637,848 | 1/1987 | Ciaramitaro et al. | 149/83 X |
| 4,708,753 | 11/1987 | Forsberg | 149/2 |
| 4,710,248 | 12/1987 | Yates et al. | 149/21 |
| 4,711,678 | 12/1987 | Ehrnström | 149/2 |
| 4,822,433 | 4/1989 | Cooper et al. | 149/2 |
| 4,836,870 | 6/1989 | Cunningham et al. | 149/2 |
| 4,875,951 | 10/1989 | Prest et al. | 149/109.6 |
| 4,934,457 | 6/1990 | Wallender | 166/304 |
| 4,936,931 | 6/1990 | Nguyen et al. | 149/2 |
| 4,936,932 | 6/1990 | Nguyen | 149/2 |
| 4,960,475 | 10/1990 | Cranney et al. | 149/2 |
| 5,026,442 | 6/1991 | Yabsley et al. | 149/2 |
| 5,074,939 | 12/1991 | Sanders et al. | 149/21 |
| 5,160,387 | 11/1992 | Sujansky | 149/2 |
| 5,397,399 | 3/1995 | Lownds | 149/106.6 |
| 5,457,707 | 10/1995 | Delagey et al. | 149/60 |
| 5,460,671 | 10/1995 | Khandhadia | 149/109.6 |
| 5,665,935 | 9/1997 | Stromquist et al. | 149/83 |
| 5,670,741 | 9/1997 | Stromquist et al. | 149/77 X |

FOREIGN PATENT DOCUMENTS

| | | |
|---|---|---|
| 86/3253 | 4/1986 | South Africa . |

*Primary Examiner*—Peter A. Nelson
*Attorney, Agent, or Firm*—Madson & Metcalf

[57] ABSTRACT

A method of blasting using non-nitrogen containing explosives which protect the environment from pollution of nitrogen compounds is provided. The method includes the following steps: (1) combining an oxidizer, a fuel, water, and a binder such that an explosive is formed which is substantially free of nitrogen; (2) placing the explosive in a location selected for blasting; and (3) initiating said explosive. The nitrogen-free oxidizer may be a perchlorate such as sodium perchlorate. Using this method, the explosive may be a water gel, emulsion, a dry explosive, or a liquid oxygen explosive.

15 Claims, No Drawings

METHODS OF BLASTING USING NITROGEN-FREE EXPLOSIVES

RELATED APPLICATIONS

This application is related to and claims priority from the filing date of U.S. Provisional Patent Application Ser. No. 60/017,034 filed May 2, 1996 and entitled "Methods of Blasting Using A Nitrogen-Free Explosive," which application is incorporated herein by this reference.

BACKGROUND

1. The Field of the Invention

The present invention relates to commercial and mining explosives which are substantially free of nitrates. More particularly, the present invention relates to explosives which do not contribute substantial to oxides of nitrogen emissions to the air, or nitrates to water, or land surrounding their use.

2. Technical Background

Nearly all commercial and mining explosives used in the world today are based on ammonium nitrate or combinations of ammonium nitrate with other alkaline and/or alkaline earth nitrate salts, such as sodium or calcium nitrate. Most explosives of this type rely on the energetic reaction of nitrogen compounds incorporated within the explosive to provide the necessary explosive power.

As a result of the high nitrogen content of these explosives, substantial nitrogen emissions are produced upon detonation. Explosives of this type have the potential to pollute land, water, and air with excess nitrogen containing compounds. Indeed, nitrogen emissions into ground water are frequently observed following use of these types of explosives. Also observed are significant levels of nitrogen oxide emissions into the air. Overall, it is found that the use of conventional mining and commercial explosives can release sufficient amounts oxides of nitrogen into the air and nitrates into water to noticeably degrade the surrounding environment.

Stricter environmental laws regulating emissions of nitrates into the water are being enacted on both the federal and state levels of government. Nitrates such as those used in and emitted by commercial and mining explosives are known to contribute nitrogen compounds to the water in such a manner that they are covered by these federal and state environmental regulations.

Likewise, laws governing the permissible emission of noxious fumes are being tightened. One of the primary areas of air pollution regulation relates to nitrogen oxide ($NO_x$) emissions. $NO_x$ emissions are regulated and closely monitored because they are known to be some of the primary contributors to smog in urban areas. Thus, the emissions produced by detonation of conventional commercial or mining explosives may be covered by these regulations as well, particularly if the explosives are used in populated areas.

Fortunately, most mines, construction sites, and other operations where blasting takes place, are located in relatively remote areas. In these areas levels of ground water nitrates are often rapidly diluted to acceptable concentrations. In addition, $NO_x$ is less of a concern outside urban areas because there are fewer air pollution emission sources in such areas. In these areas the gaseous fumes produced in blasting operations generally dissipate and cause no immediate problem. However, emission of nitrogen oxides is still a concern in that the overall environment is being slowly degraded even from these remote and relatively small releases of nitrogen oxides.

There are occasional needs for blasting and mining operations even in relatively urbanized areas. These operations include construction of large buildings and construction and repair of roadways. A specific example relates to the production of rock base for construction uses. In certain hard rock granite quarries the blasted granite is crushed and fed through a kiln where it is mixed with asphalt to form road base. The fumes emanating from the stacks of this type of kiln have been tested by environmental authorities and occasionally found to exceed the permissible limits for $NO_x$. These nitrate emissions could come from several sources, some of which are directly linked to blasting operations. Such sources include, for example: spilled explosive around the borehole or between the boreholes during the explosive loading procedure; explosive in the borehole which did not detonate because it was not formulated properly or it mixed with ground water in the borehole, dissolving some of the nitrates which subsequently were not consumed in the detonation reaction; explosive material trapped in small fissures or cracks in the borehole which was prevented from being consumed in the detonation reaction; or priming system malfunction.

Various steps have been taken to limit nitrogen emissions from the sources listed above. However, even extraordinary measures to prevent release of nitrogen oxides do not fully insure that some of the explosive will not find its way into the surrounding environment. For example, $NO_x$ may be released into the atmosphere because of a less than ideal explosive reaction. It is also difficult to completely insure that nitrogen is not released into the water or ground surrounding the blasting site.

Thus, it would be a substantial advancement in the art to provide methods for blasting which did not release nitrogen into the surrounding air or water. In particular, it would be a substantial advancement to provide blasting methods which did not add to $NO_x$ emissions in the area of the blast. It would be a further advancement in the art to prevent nitrate ion from entering the ground water or land surrounding a blasting site.

Such methods of eliminating nitrogen emissions from commercial and mining explosives are disclosed and claimed herein.

DESCRIPTION OF THE INVENTION

The present invention relates to methods of blasting which substantially avoid the release of unwanted nitrogen compounds into the air and water surrounding the blasting site. The basic concept of the present invention is to eliminate nitrogen containing ingredients from the explosive composition as originally formulated. With no nitrogen present in the explosive it is impossible to release nitrogen containing compounds either into the atmosphere or into the ground.

The present invention specifically relates to explosives used in commercial, construction, agriculture, mining, and similar civilian uses. Such applications are generally referred to herein as commercial and mining applications. Explosives used in these applications are generally referred to as "commercial and mining" explosives, even though explosives of this type may have applications beyond the strict limits of commercial and mining application. The present invention does not specifically relate to explosives, pyrotechnics, smokes, and other compositions used in military applications and the like. Thus, it will be appreciated by those of skill in the art that in the context of commercial and mining explosives, the elimination of nitrogen from the composition is novel in that such explosives conventionally rely on a high nitrogen composition to provide the necessary explosive energy.

The present invention may be used in a number of different contexts. The commercial or mining explosive may be an emulsion (either water-in-oil or oil-in-water), dry explosive, water gel, or any other conventional form well known in the art. Explosives of these types generally include a fuel, an oxidizer, and a binder, along with other ingredients necessary to impart the desired characteristics.

The present invention, however, teaches the substitution of conventional nitrogen-containing oxidizers, such as ammonium nitrate, with nitrogen-free oxidizers. Such oxidizers include perchlorates. In one preferred embodiment, the present invention teaches the use of sodium perchlorate. Other similar oxidizers include calcium or lithium perchlorate, chlorates, and liquid oxygen. Surprisingly, it is found that acceptable explosive compositions can be formulated without nitrogen-containing oxidizers.

The methods of the present invention also teach the use of substantially nitrogen-free fuels. Glycols, such as ethylene glycol, are a preferred group of fuels. Other fuels may, for example, include miscible fuels such as polyalcohols, alcohols, and sugars. It is also possible to use immiscible fuels such as fuel oil, alkanes, or waxes. Examples of other fuels include coal dust, gilsonite, pitches, aluminum, and other metals. Some of the types of fuels usable in the present invention are listed in U.S. Pat. No. 3,765,967, which patent is incorporated herein by this reference.

Other conventional additives may be included in the explosive as needed and desired. Such additives include water, emulsifiers, catalysts, binders, gassing agents, cross-linking agents, and the like. Materials of these types are well known in the commercial explosives art.

In some applications it is desirable that the explosive be formulated at the blasting site. This can be done with the compositions and methods of the present invention. In one embodiment, bulk quantities of oxidizer, fuel, gassing agent, and cross-linker are loaded in separate containers on a blasting pump truck. The truck is equipped with the capability of pumping each ingredient in the desired proportions into a mixing vessel. The combined explosive is then directed into a borehole or other blasting site. This method can be practiced using well known and commercially available equipment and machinery. The present invention is also applicable to packaged explosives using standard explosive loading techniques.

The present invention significantly reduces the emission of $NO_x$ in the air and nitrates in the water since the subject explosives contain no nitrate oxidizer salts. Thus, the environmental problems related to the use of nitrogen-containing oxidizer salts in conventional commercial and mining explosive is eliminated by the methods and compositions of the present invention.

These and other objects and advantages of the invention will become apparent upon reading the following detailed description and appended claims.

DETAILED DESCRIPTION OF THE PREFERRED EMBODIMENTS

The present invention is related to methods of blasting employing commercial or mining explosive compositions, while substantially eliminating the emission of nitrogen during the use of such explosives. The method includes the steps of: (1) formulating an explosive composition comprising a substantially nitrogen-free oxidizer and a substantially nitrogen-free fuel; placing a quantity of said explosive composition at the desired blasting location; and initiating the explosive composition. In most applications, the blasting location comprises a borehole.

Importantly, the present invention does not use the nitrogen salt oxidizers conventionally found in commercial and mining explosives. Rather, the present invention prefers the use of at least one nitrogen-free containing perchlorate, such as sodium perchlorate. Other nitrogen-free oxidizers may also be used.

As mentioned above, the methods of the present invention also teach the use of nitrogen-free fuels. Such fuels may include glycols, such as ethylene glycol. Other fuels include immiscible fuels such as fuel oil, alkanes, and waxes. Alternatively, the fuel component may include coal dust, gilsonite, pitch, aluminum, or other metals. The composition may also include other conventional explosive components. These include, for example, binders such as guar gum, emulsifiers, gassing agents, cross-linking agents, and catalysts.

Typical explosives for use within the scope of the present invention could include the following ingredients in the following percentage ranges:

from about 45% to about 60% of at least one nitrogen-free perchlorate;

from about 15% to about 25% fuel;

from about 20% to about 35% water;

from about 0.1% to about 5% binder.

This composition is then placed at the desired blasting location. When the composition is placed in the desired location, the explosive composition is initiated by conventional means.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

The following materials are combined in the following percentages:

| | |
|---|---|
| Sodium Perchlorate | 57.80 |
| Water | 20.00 |
| Ethylene glycol | 21.00 |
| Modified guar gum and crosslinker | 1.20 |
| Total | 100.00 |

The explosive composition has a density of approximately 1.25, which may be controlled further by the addition of a bulking agent such as glass microballoons, or from chemical gassing from sodium nitrite and/or thiourea. Peroxides could also be used to gas the composition.

In mixing the explosive, the sodium perchlorate, water, and ethylene glycol are first mixed together at approximately 30 C°. The guar gum and crosslinker are then added and mixed with the density control agent. Even though this composition does not contain solid materials, the thickener and crosslinker improves the handling properties of this product.

Example 2

The following materials are combined in the following percentages:

| | |
|---|---|
| Sodium Perchlorate | 56.90 |
| Water | 19.00 |
| Ethylene glycol | 18.00 |
| Modified guar gum and crosslinker | 1.10 |
| Aluminum | 5.00 |
| Total | 100.00 |

These ingredients are combined to form an explosive composition. Thickening and crosslinking of the composition allows for the solid materials to be suspended in the composition.

SUMMARY

Thus, the present invention provides methods of blasting in a commercial or mining setting which avoid the release of unwanted nitrogen into the environment. In particular, the methods of the present invention prevent the emission of unwanted nitrogen oxides into the air. The methods also prevent the emission of unwanted nitrogen compounds into the ground and the water. Accordingly, the present invention solves one of the complex environmental problems encountered in commercial and mining blasting operations.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by Letters Patent is:

1. A method of blasting employing commercial or mining explosive compositions, while substantially eliminating the emission of nitrogen during the use of such explosives, comprising the steps of:

formulating an explosive composition comprising a substantially nitrogen-free oxidizer and a substantially nitrogen-free fuel said explosive consisting essentially of from about 45% to about 60% of at least one nitrogen-free perchlorate; from about 15% to about 25% fuel; from about 20% to about 35% water; from about 0.1% to about 5% binder;

pumping a quantity of said explosive composition to the desired blasting location; and initiating the explosive composition.

2. A method of blasting as defined in claim 1 wherein said blasting location comprises a borehole.

3. A method of blasting as defined in claim 1 wherein said perchlorate comprises sodium perchlorate.

4. A method of blasting as defined in claim 1 wherein said explosive is a water gel.

5. A method of blasting as defined in claim 1 wherein said explosive is an emulsion.

6. A method of blasting as defined in claim 1 wherein said fuel comprises a glycol.

7. A method of blasting as defined in claim 1 wherein said binder comprises guar gum.

8. A method of blasting as defined in claim 1 wherein said explosive composition further comprises an emulsifier.

9. A method of blasting as defined in claim 1 wherein said explosive composition further comprises a gassing agent.

10. A method of blasting as defined in claim 1 wherein said explosive further comprises a cross-linking agent.

11. A method of blasting as defined in claim 1 wherein said explosive further comprises a catalyst.

12. A method of blasting as defined in claim 1 wherein said explosive further comprises a binder.

13. A method of blasting as defined in claim 1 wherein said fuel comprises ethylene glycol.

14. A method of blasting as defined in claim 1 wherein said fuel is selected from the group consisting of fuel oil, alkanes, and waxes.

15. A method of blasting as defined in claim 1 wherein said fuel is selected from the group consisting of coal dust, gilsonite, pitch, and aluminum.

* * * * *